US007586260B2

(12) United States Patent
Tonegawa et al.

(10) Patent No.: US 7,586,260 B2
(45) Date of Patent: Sep. 8, 2009

(54) ELECTRON DEVICES WITH NON-EVAPORATION-TYPE GETTERS AND METHOD FOR MANUFACTURING THE SAME

(75) Inventors: Takeshi Tonegawa, Chiba (JP); Shigeo Itoh, Chiba (JP); Sadanori Takayama, Chiba (JP); Masateru Taniguchi, Chiba (JP); Yasumoto Kubo, Chiba (JP); Kenji Nawamaki, Chiba (JP); Youhei Fujimura, Chiba (JP); Mamoru Namikawa, Chiba (JP); Yoshihisa Marushima, Chiba (JP); Osamu Idohara, Kanagawa (JP); Yoshiaki Inoue, Kanagawa (JP); Seiji Yokota, Kanagawa (JP); Kazuhiro Kawasaki, Kanagawa (JP)

(73) Assignees: Futaba Corporation, Mobara-shi, Chiba-ken (JP); Neturen Co., Ltd., Hiratsuka-shi, Kanagawa-ken (JP)

( * ) Notice: Subject to any disclaimer, the term of this patent is extended or adjusted under 35 U.S.C. 154(b) by 336 days.

(21) Appl. No.: 11/358,638

(22) Filed: Feb. 21, 2006

(65) Prior Publication Data

US 2006/0197428 A1 Sep. 7, 2006

(30) Foreign Application Priority Data

Feb. 21, 2005 (JP) ..... 2005-044815

(51) Int. Cl.
*H01J 17/24* (2006.01)
*H01J 63/04* (2006.01)
*H01J 1/62* (2006.01)

(52) U.S. Cl. ..... 313/553; 313/498; 313/310; 313/497; 428/464; 252/181.1

(58) Field of Classification Search ..... None
See application file for complete search history.

(56) References Cited

U.S. PATENT DOCUMENTS

| | | | | |
|---|---|---|---|---|
| 3,082,174 | A | 3/1963 | Perdijk et al. | |
| 3,187,885 | A | 6/1965 | Hansen et al. | |
| 3,620,645 | A * | 11/1971 | della Porta et al. | 428/553 |
| 4,430,537 | A * | 2/1984 | Sauer et al. | 200/302.1 |
| 6,383,050 | B1 | 5/2002 | Ishikura et al. | |
| 6,559,596 | B1 | 5/2003 | Arai et al. | |

FOREIGN PATENT DOCUMENTS

| | | |
|---|---|---|
| EP | 1020889 | 7/2000 |
| JP | 9509525 | 9/1997 |
| JP | 2000208033 | 7/2000 |
| JP | 2000311588 | 11/2000 |
| JP | 2001283721 | 12/2001 |
| JP | 2002524379 | 8/2002 |
| WO | 0015556 | 3/2000 |

* cited by examiner

*Primary Examiner*—Sikha Roy
*Assistant Examiner*—Tracie Y Green
(74) *Attorney, Agent, or Firm*—Quarles & Brady LLP

(57) ABSTRACT

A non-evaporation getter material suitable for non-evaporation getters disposed in electron devices, such as fluorescent luminous tubes. The getter material is sized and shaped to more efficiently absorb gases actively at low temperatures.

10 Claims, 8 Drawing Sheets

MEASURED VALUES OF ZrV

| | SAMPLE A | SAMPLE B | SAMPLE C | SAMPLE D |
|---|---|---|---|---|
| DENSITY ($g/cm^3$) | 6.4 | 6.4 | 6.4 | 6.4 |
| SPECIFIC SURFACE AREA ($m^2/g$) | 0.23 | 0.85 | 5.88 | 16.13 |
| AVERAGE PARTICLE DIAMETER (μm) | 16.3 | 4.4 | 1.9 | 0.9 |
| MAXIMUM PARTICLE DIAMETER (μm) | 65 | 30 | 5.1 | 2.3 |

ELECTRON DEVICES WITH NON-EVAPORATION-TYPE GETTERS AND METHOD FOR MANUFACTURING THE SAME

CROSS REFERENCE TO RELATED APPLICATIONS

Not applicable.

STATEMENT REGARDING FEDERALLY SPONSORED RESEARCH

Not Applicable.

BACKGROUND OF THE INVENTION

The present invention is related electron devices. In particular, electron devices including a non-evaporation-type getter and methods for manufacturing the electron devices.

Conventional electron devices, such as fluorescent luminous tubes, include hermetic envelopes (containers). A fluorescent luminous tube, which uses a non-evaporation getter (i.e. non-evaporation getter materials) applied on a black matrix formed on an anode substrate to absorb gases inside the vacuum envelope, has been proposed (for example, refer to Japanese Laid-open Patent publication No. Tokkai 2001-351510).

A conventional fluorescent luminous tube having non-evaporation getters will be explained below by referring to the fluorescent luminous tube of FIG. 8, which is a field emission display (FED) using field emission-type cathodes. In FIG. 8, FIG. 8(*a*) is a front view illustrating the field emission display viewed from an anode substrate side, and FIG. 8(*b*) is a cross-sectional view illustrating the field emission display taken along line X1-X1.

The field emission display has a vacuum envelope (container) which is formed of an anode substrate 11 and a cathode substrate 12. The anode substrate 11 and cathode substrate 12 are bonded together with seal glass pieces (side members) 13. Anodes 21, each in which a fluorescent substance is coated on an anode electrode, are formed over the anode substrate 11. A black matrix 22 is formed over the anode substrate 11, except anodes 21. Field emission cathodes 31 are formed over the cathode substrate 12.

Non-evaporation getter materials, such as chemical compounds of Ti or Zr, are mixed in the black matrix 22. In order to form the black matrix 22, an aqueous solution (carbon aqueous solution) is coated onto the anode substrate 11 and then the anode substrate is heated in the atmosphere at 545° C. The carbon aqueous solution is prepared by adding non-evaporation getter materials of a particle diameter of 1 μm or less into aqueous solution containing a glass series adhesive agent or binder (containing chiefly carbon).

Conventional non-evaporation getter materials having a particle diameter of about 1 μm have been used sparingly. However, the particle size, particle shape, and processing temperature, suitable for the getter, have not been disclosed. For example, when non-evaporation-type materials are mixed in the black matrix to form a getter, the non-evaporation materials are heated at about 545° C. during the black matrix forming process. The non-evaporation getter material, for example, ZrV, reacts chemically with gases most actively at a temperature of about 320° C. (hereinafter referred to as activation temperature). While being mixed in the black matrix, non-evaporation getter materials will absorb a large volume of gases through the chemical reaction. For that reason, when the vacuum envelope is sealed and evacuated, the active surface of the getter material is in a reduced state and in a gas absorption completion state. The getter in the vacuum envelope remarkably reduces its gas absorbing ability when gases absorbed on the envelope wall are sputtered out with electron rays. As a result, the black matrix reduces the getter capability. Since $TiO_2$, or a non-evaporation getter material, is white, mixing a large volume of $TiO_2$ leads to reducing the effect of the black matrix whereas a small volume of $TiO_2$ leads to reducing the getter effect.

SUMMARY OF THE INVENTION

With the view to the above-mentioned problems, the particle size, specific area, particle shape, processing temperature, and so on of a non-evaporation-type getter material, suitable for getters, were determined. An object of the present invention is to provide electron devices, such as fluorescent luminous tubes, each having a vacuum envelope in which a getter made of a non-evaporation-type getter material suitable for a getter is disposed. Another object of the present invention is to provide a method for manufacturing an electron device suitably accepting the getter material.

In order to achieve the above-mentioned objects, an electron device according to the present invention comprises a hermetic envelope; and a non-evaporation getter disposed in the hermetic envelope; the non-evaporation getter being formed of a non-evaporation getter material selected from the group consisting of metals including Ta, Ti, Zr, Th, V, Al, Fe, Ni, W, Mo, Co, Nb, Hf and a combination of the metals, any chemical compound of the metals, and a hydride of the metals; the non-evaporation getter having a specific surface area of 5 $m^2/g$ or more and a scale-like particle form.

In another aspect of the present invention, an electron device comprises, a hermetic envelope; and a non-evaporation getter disposed in the hermetic envelope; the non-evaporation getter being formed of a non-evaporation getter material selected from the group consisting of a chemical compound of Zr and a hydride of Zr; the non-evaporation getter having an average particle diameter of 2 μm or less, a specific surface area of 5 $m^2/g$ or more, and a scale-like particle form. In the electron device according to the present invention, the maximum particle diameter of non-evaporation getter material is 5.1 μm or less.

In yet another aspect of the present invention, an electron device comprises a hermetic envelope; and a non-evaporation getter disposed in the hermetic envelope; the getter being formed of a non-evaporation getter material selected from the group consisting of a chemical compound of Zr and a hydride of Zr; the non-evaporation getter having an average particle diameter of 0.9 μm or less, a specific surface area of 16 $m^2/g$ or more, and a scale-like particle form. In a preferred electron device according to the present invention, the maximum particle diameter of the non-evaporation getter material is 2.3 μm or less, the non-evaporation getter material is ZrV or $ZrH_2$, and/or the length ratio of each particle of the non-evaporation getter material is 1:5 or more.

In still another aspect of the present invention, an electron device manufacturing method comprises the steps of sealing an anode substrate produced in an anode fabrication step and a cathode substrate produced in a cathode fabrication step, so as to confront each other, and subjecting the substrates to an evacuation step; and printing and drying a non-evaporation getter onto the anode substrate or the cathode substrate or onto both of them; the printing and drying step being performed after other steps in which a calcination temperature is higher than an activation temperature of a non-evaporation getter material and prior to the sealing and evacuation step.

In the electron device manufacturing method according to the present invention, the step of drying a printed non-evaporation getter material is performed at a temperature lower than the activation temperature of the non-evaporation getter material.

In the electron device manufacturing method according to the present invention, an organic solvent for a paste used to print the non-evaporation getter material is formed of a material that evaporates at a temperature lower than the activation temperature of the non-evaporation getter material.

In the electron device manufacturing method according to the present invention, a paste used to print the non-evaporation getter material is formed of a material that contains a non-evaporation getter material in particle form dispersed in an organic solvent.

In the electron device manufacturing method according to the present invention, the non-evaporation getter material having an average particle diameter of 2 μm or less, a specific surface area of 5 $m^2/g$ or more, and a scale-like particle form.

In the electron device manufacturing method according to the present invention, the non-evaporation getter material is made of a material that is ground through the bead mill method.

In the electron device manufacturing method according to the present invention, the non-evaporation getter formed of a getter material selected from the group consisting of metals including Ta, Ti, Zr, Th, V, Al, Fe, Ni, W, Mo, Co, Nb, and Hf, and any combination of said metals, a chemical compound of said metals, and a hydride of said metals.

In yet another aspect of the present invention, a non-evaporation getter is made of a getter material selected from the group consisting of metals including Ta, Ti, Zr, Th, V, Al, Fe, Ni, W, Mo, Co, Nb, Hf, and any combination of the metals, a chemical compound of the metals, and a hydride of said metals, the non-evaporation getter having a specific surface area of 5 $m^2/g$ or more and a scale-like particle form.

In another aspect of the present invention, a non-evaporation getter is made of a getter material selected from the group consisting of a chemical compound of Zr and a hydride of Zr, said non-evaporation getter having a specific surface area of 5 $m^2/g$ or more, and a scale-like particle form.

In a still further aspect of the present invention, a non-evaporation getter is made of a getter material selected from the group consisting of a chemical compound of Zr and a hydride of Zr, the non-evaporation getter having an average particle diameter of 0.9 μm or less, a specific surface area of 16 $m^2/g$ or more, and a scale-like particle form. Preferably, the non-evaporation getter is dispersed in an organic solvent.

A non-evaporation getter material, such as ZrV, according to the present invention, has an average particle diameter of 2 μm or less, a specific surface area of 5 $m^2/g$ or more, and a scale-like particle shape. This allows that getter material to absorb gases at temperatures lower than that of the ring getter material having a coarse particle diameter and a specific surface area of 1. Therefore, the getter material according to the present invention sufficiently absorbs gases when an electron device, such as a fluorescent luminous tube, is sealed and evacuated while absorbing gases generated during operation of the electron device. Therefore, the operational life of an electron device can be prolonged.

In the method of manufacturing electron devices, such as fluorescent luminous tubes, according to the present invention, the non-evaporation-type getter material, such as ZrV, is not heated at temperatures lower than the activation temperature thereof in steps prior to the sealing and evacuating step. Therefore, the getter capability is not reduced due to the previous absorption of gases in steps prior to the sealing and evacuating step.

In a method of manufacturing electron devices, such as fluorescent luminous tubes, according to the present invention, a non-evaporation getter is formed through printing and then drying a non-evaporation getter material, such as ZrV. The drying temperature is less than the activation temperature of the non-evaporation getter material. Hence, when the non-evaporation getter is formed (dried), the non-evaporation-type getter material absorbs only a small amount of gases. Preferably, the non-evaporation getter material, such as ZrV, according to the present invention has an average particle diameter of 2 μm or less and a scale-like particle shape. Hence, the non-evaporation getter material exhibits a strong adhesive strength even after printing and drying, so that the non-evaporation getter is not easily removed.

Since the non-evaporation getter material, such as ZrV, according to the present invention, is produced through the grinding step in the bead mill method, the particle shape becomes a scale-like form. Moreover, a solvent for a paste used for the getter printing evaporates at temperatures lower than the activation temperature of the non-evaporation getter material, such as ZrV. Hence, that paste can be dried at temperatures lower than the activation temperature of the getter material after the paste printing step.

BRIEF DESCRIPTION OF THE DRAWINGS

This and other objects, features, and advantages of the present invention will become more apparent upon reading of the following detailed description and drawings, in which:

FIG. 1(*b*) is a cross-sectional view illustrating a field emission device (FED), according to an embodiment of the present invention;

FIG. 5(*b*) shows measured values of samples;

FIG. 7(*b*) is a photograph under a scanning electron microscope showing a raw non-evaporation-type getter material;

FIG. 8(*b*) is a cross-sectional view illustrating a conventional fluorescent luminous tube.

BEST MODE FOR EMBODYING THE INVENTION

Figure 1A:
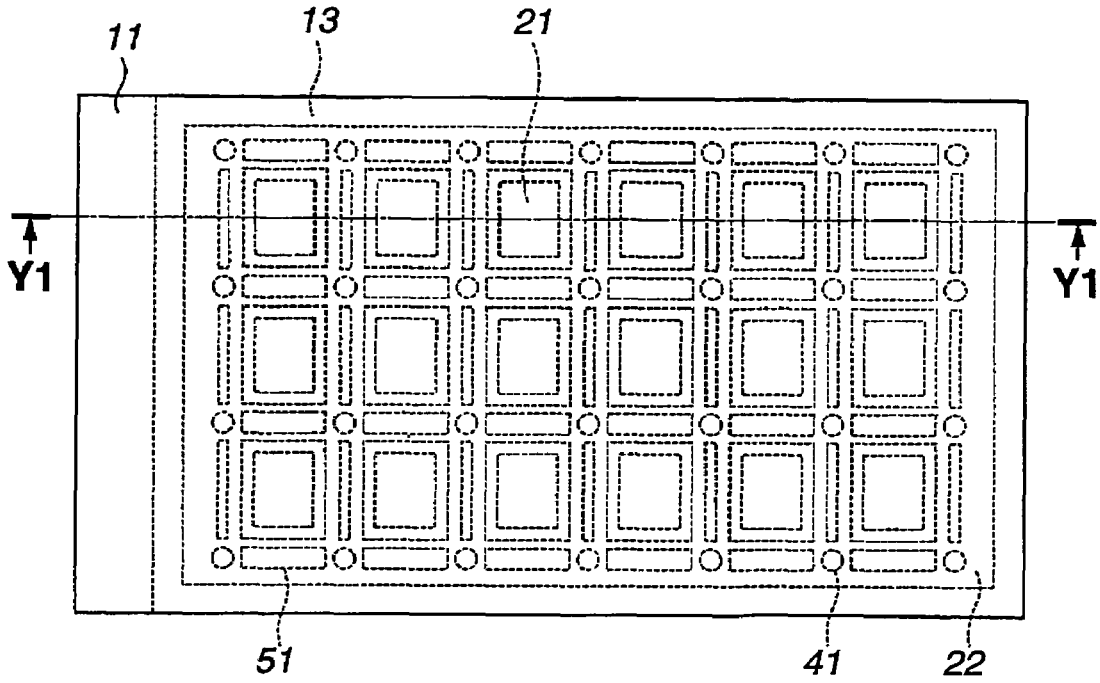
FIG. 1(*a*) is a front view illustrating a field emission device (FED), according to an embodiment of the present invention.
Figure 1B:
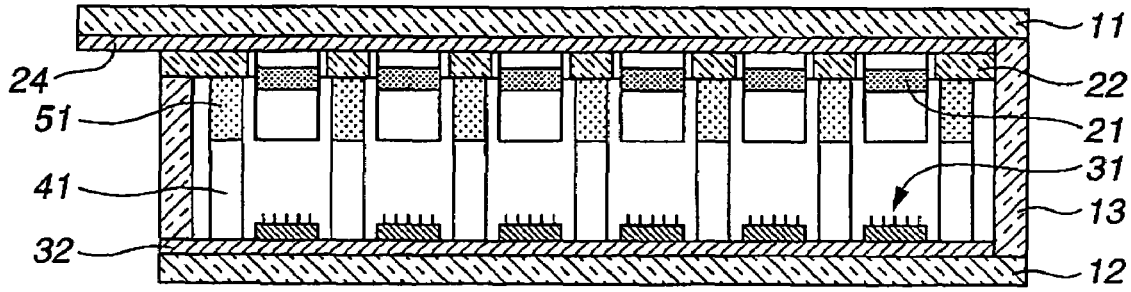

An embodiment of the present invention will be explained below by referring to FIGS. 1 to 7. In the figures, like numerals are attached to the same constituent elements. FIG. 1(*a*) is a front view illustrating a diode-type field emission display (FED), using field emission-type cathodes viewed from the anode substrate, and corresponds to one electron device according to the preferred embodiment of the present invention. FIG. 1(*b*) is a cross-sectional view of the FED taken along line Y1-Y1 of FIG. 1(*a*).

Referring to FIG. 1, numeral 11 represents an anode substrate; numeral 12 represents a cathode substrate; numeral 13 represents a seal glass (side surface member); numeral 21 represents an anode in which a fluorescent substance is coated on an anode electrode; numeral 22 represents a black matrix; numeral 31 represents a cathode using a carbon nanotube (CNT); numeral 41 represents a pressure-tight support; and numeral 51 represents a non-evaporation getter. The black matrix 22 is formed using a black glass fabric working as an insulating film (cloth).

The anode substrate 11 and the cathode substrate 12 are bonded with seal glass 13 to fabricate a vacuum envelope (container). Anodes 24 and aluminum (AL) wiring conductors (metallization) 24 connecting the anodes 21 are formed over the anode substrate 11. A black matrix 22 is formed so as to overlay the AL conductors 24, except the anodes 21. Cathodes 31 and ITO (transparent conductive film) metallization 32, which connects the cathode 31, are formed over the cathode substrate 12. In the black matrix 22, non-evaporation getters 51 are formed between the anodes 21 (i.e. around anodes 21). Supports 41 are disposed between the black matrix 22 and the cathode substrate 12. The non-evaporation getter 51 has the composition described herein and is preferably made through the method described further below.

The example of forming cathodes 31 on the cathode substrate 12, shown in FIG. 1, has been explained. However, in fluorescent display tubes, which uses cathode filaments, the cathode filaments can be attached onto the anode substrate 11 or the cathode substrate 11. When filaments are attached to the anode substrate 11, the substrate confronting the anode substrate 11 is called a cathode substrate.

When a voltage is applied between one of the anodes 21 and a cathode 31, the cathode 31 emits electrons and excites and light-emits the fluorescent substance coated on the selected anode 21. The spacing between the anode substrate 11 and the cathode substrate 12 is about 10 to 50 μm. In the field emission display of FIG. 1, the substrate spacing is very small, e.g. 30 μm. However, as described later, the non-evaporation getter material, which has an average particle diameter of about 2 μm and a maximum particle diameter of 5.1 μm, does not disturb the formation of the non-evaporation getter 51.

Figure 2A:
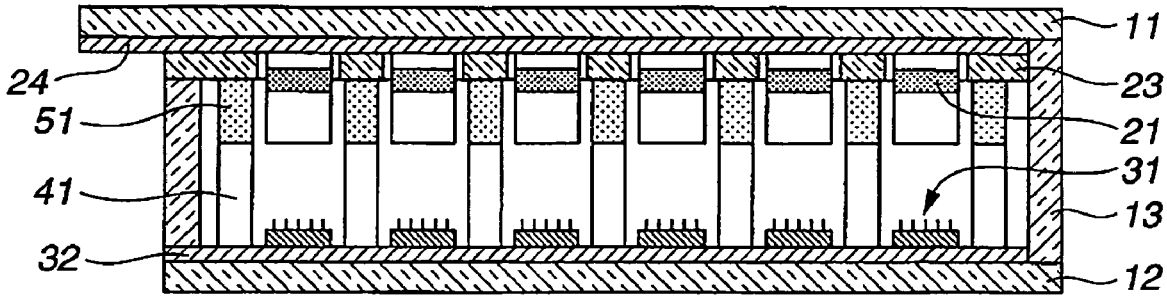
FIGS. 2(*a*), 2(*b*), and 2(*c*) are views illustrating a modification of the field emission device (FED), shown in FIG. 1, in which a non-evaporation-type getter is located at a different place.
Figure 2B:
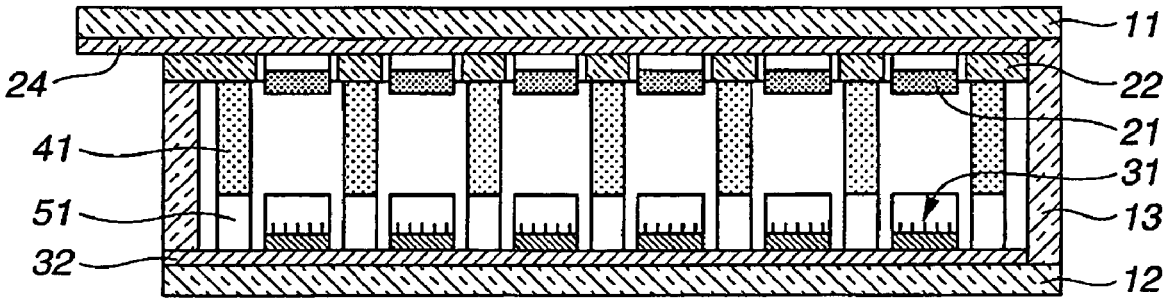
Figure 2C:
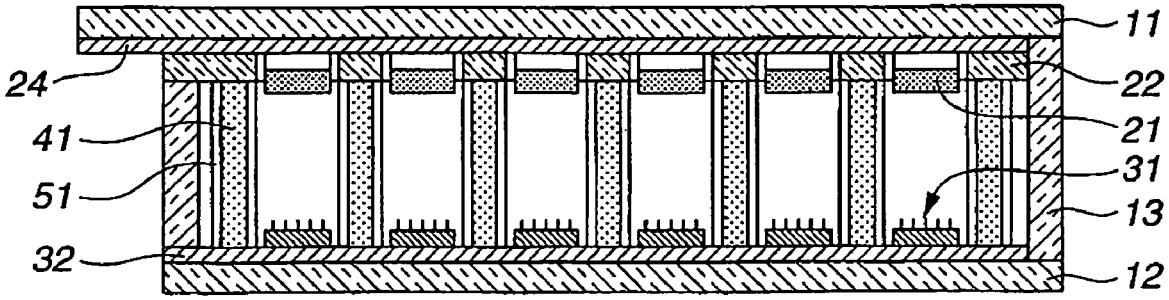

FIG. 2 shows modified locations of the non-evaporation getters 51. FIG. 2(*a*) shows non-evaporation getters 51 formed between the anodes 21, in a manner similar to that in FIG. 1. The insulating layer (cloth) 23, which is not black, is formed in place of the black matrix 22 shown in FIG. 1. FIG. 2(*b*) shows non-evaporation getter 51 formed between the cathodes 31 on the cathode substrate 12. The supports 41 are arranged between the cathode substrate 12 and the black matrix 22 on the anode substrate 11. FIG. 2(*c*) shows a non-evaporation-type getter 51 formed around each support 41.

Some field emission displays employ a three-dimensional wiring scheme in which wiring conductors on the cathode substrate and the wiring conductors on the anode substrate are connected together via connecting members. The connecting members may be formed of a metal non-evaporation getter material. In that case, the non-evaporation getter material for the getter serves as the connecting member.

Figure 3:
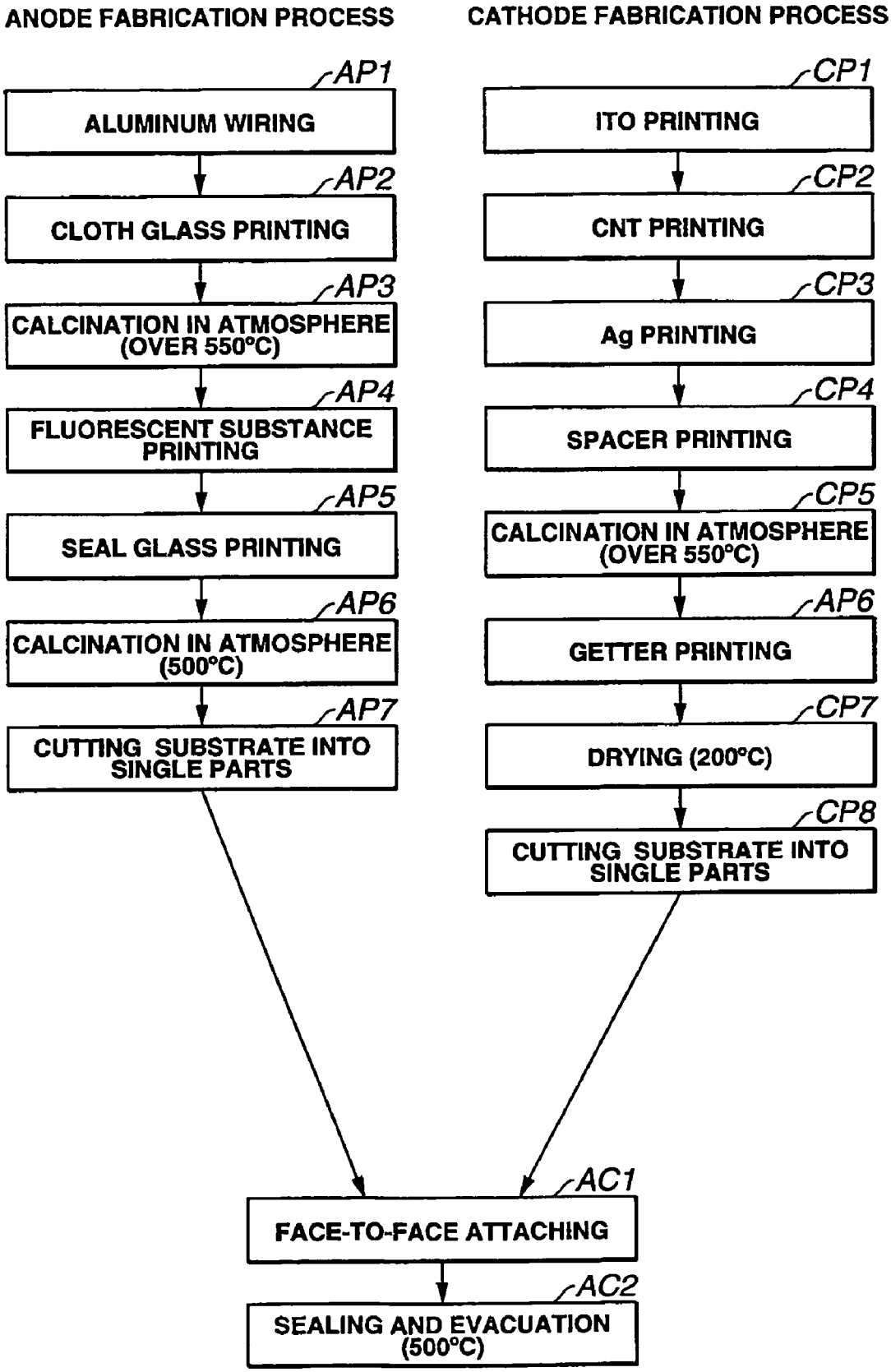
FIG. 3 is a flowchart illustrating steps of manufacturing a field emission device (FED), according to an embodiment of the present invention.
Figure 4:
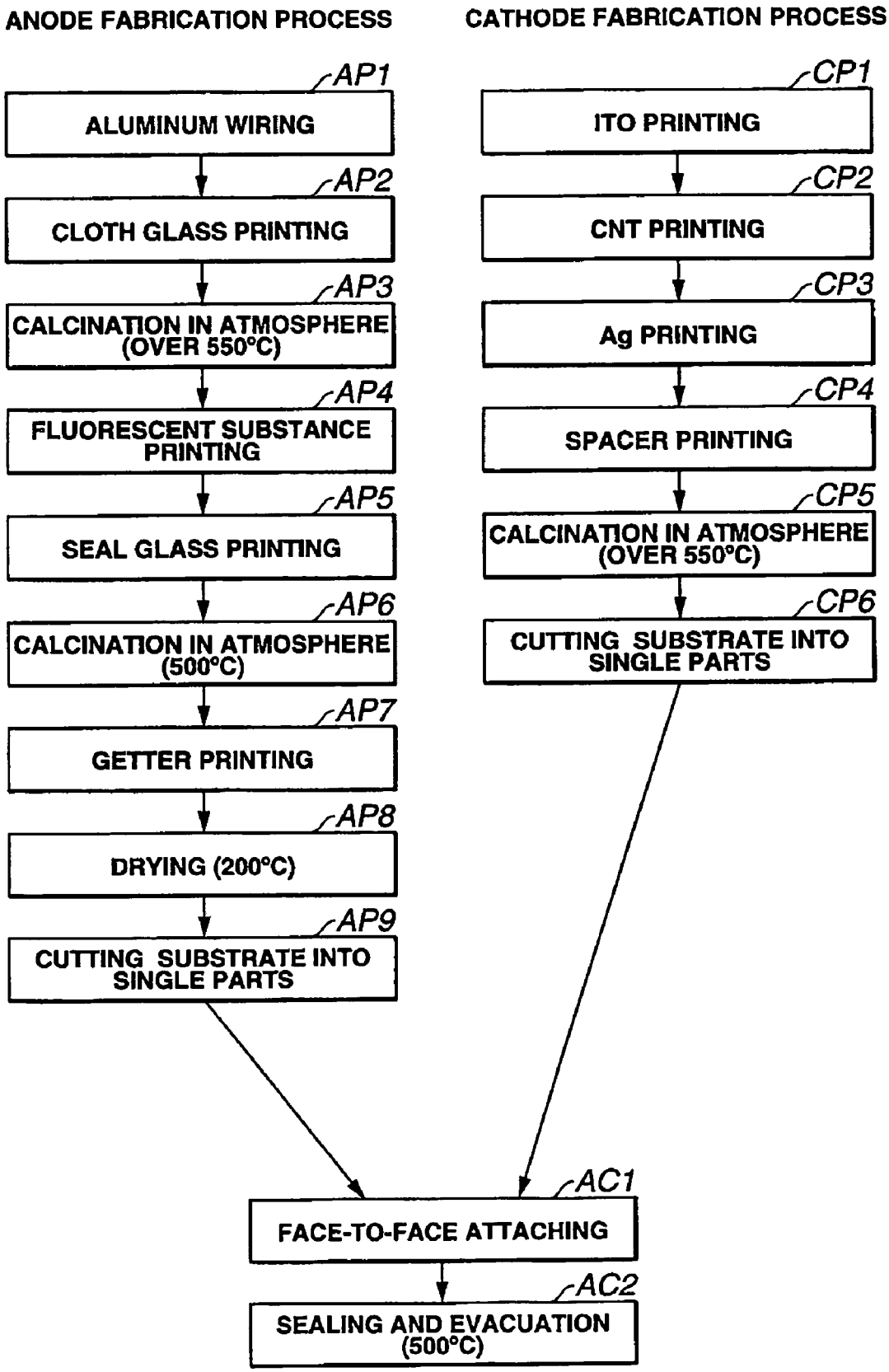
FIG. 4 is a flowchart illustrating steps of manufacturing a field emission device (FED), which includes a step order partially different from that shown in FIG. 3, according to an embodiment of the present invention.

FIGS. 3 and 4 show a method of manufacturing a field emission display according to an embodiment of the present invention. FIG. 3 shows an example of forming non-evaporation getters 51 over a cathode substrate. FIG. 4 shows an example of forming non-evaporation getters 51 over an anode substrate.

A preferred field emission display manufacturing process is explained below with reference to FIG. 3. In an anode fabrication step, A1 wiring conductors are formed on a substrate, e.g. glass (AP1). A cloth glass (or a black glass in the black matrix) is printed over the substrate (AP2) and heated and calcined in the atmosphere at 550° C. or more (AP3). Next, a fluorescent substance is printed (AP4). A seal glass is printed (AP5) and then is calcined in the atmosphere at 500° C. (AP6). The intermediate structure is cut into single parts after calcination in the atmosphere (AP7). When a single field emission display is fabricated, it is not necessary to cut the anode substrate into single parts. However, since respective anode substrates for multiple field emission displays are generally formed on a single large glass plate, cutting the glass plate into single parts is preferred.

In the cathode fabrication step, ITO is printed over a substrate, such as glass (CP1) and a CNT (carbon nanotube), is printed for cathodes (CP2). The wiring lead-out sections of the anode substrate 11 and the wiring lead-out sections of the cathode substrate 12, (each of which is connected to the drive modules) are consolidated on the anode substrate. For that reason, Ag is printed (CP3) to form protruded conductive portions, which connect the wiring conductors on the cathode substrate 12 and the lead-out sections on the anode substrate 11. Following the Ag printing step (CP3), spacers (supports) are printed (CP4). The resultant structure is calcined at 550° C. or more (CP5). Getters are printed (or a paste of a non-evaporation getter material is printed) (CP6). The intermediate structure is dried at 200° C. to evaporate the paste solvent (to be described later), so that a non-evaporation getter is formed (CP7). The substrate is cut into single parts (CP8).

The resultant anode substrate 11 and the resultant cathode substrate 12 are face-to-face attached (both the substrates are overlapped via the seal glass) (AC1). The resultant structure is heated at 500° C. to melt the seal glass while it is being evacuated which bonds the substrates 11, 12 together (AC2) and forms the field emission display.

In the cathode fabrication step of FIG. 3, the ITO printing, CNT printing, and the spacer printing are first performed, and then the intermediate structure is calcined in the atmosphere. Thereafter, the getter is printed thereon and then dried. Advantageously, the non-evaporation getter material is not adversely affected due to the calcination in the atmosphere. Therefore, the non-evaporation getter material does not reduce gettering capability due to absorption of a large volume of gases before the sealing and evacuation steps (AC2). Because the paste solvent used for the getter printing (CP6) is dried and evaporated at temperatures lower than the activation temperature of ZrV (around 320° C.), the non-evaporation material does not activate in the paste drying step (CP7). Advantageously, because the non-evaporation getter material is first heated at temperatures lower than the activation temperature of ZrV in the sealing and evacuation step (AC2), it can sufficiently absorb gases in the sealing and evacuation step (AC2).

ZrV can be substituted for Ag. ZrV used in the present embodiment, which is in a scale-like grain shape (to be described later), loses metallic luster. Therefore, ZrV can be disposed inside the field emission display, without adversely affecting the display state.

Next, an alternate fabrication process shown in FIG. 4 is explained below. In the alternate fabrication process, the getter printing step and the drying step in the cathode fabrication process of FIG. 3 are moved into the anode fabrication process. The getter printing step (AP7) and the drying step (AP8) follow the calcination-in-atmosphere step (AP6). Other steps correspond to those in the fabrication steps in FIG. 3. Because the getter printing step (AP7) is performed after the calcination in the atmosphere (AP6), the non-evaporation material is not influenced by the calcination-in-atmosphere step. In the alternate fabrication process, both the seal glass printing (AP5) and the calcination in atmosphere (AP6) can be moved next to the calcination-in-atmosphere step (CP5) in the cathode fabrication process.

Figures 5A, 5B:
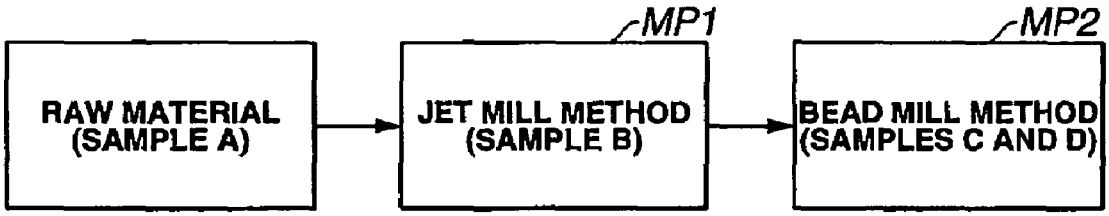
FIG. 5(*a*) is a flowchart illustrating a process for grinding a non-evaporation-type getter material, according to an embodiment of the present invention.

FIG. 5 shows both the step of grinding non-evaporation getter material samples and measured values of samples. FIG. 5(*a*) shows the grinding step and FIG. 5(*b*) shows the measured values of samples in each step. Samples A to D use a non-evaporation getter material, ZrV. Referring to FIG. 5(*b*), the specific surface areas are values obtained in the BET method and average particle diameter values are obtained by using laser diffraction.

Referring to FIG. 5(*a*), the raw material (sample A), not powdered, has an average particle diameter of 16.3 μm and a maximum particle diameter 65 μm. The raw material is ground using the dry jet mill method (MP1) to prepare sample B. Sample B has an average particle diameter of 4.4 μm and a maximum particle diameter of 30 μm. Sample B is ground using the wet bead mill method (MP2) to prepare samples C and D. Sample D is produced by grinding it for a grinding time longer than that of sample C. Sample C has an average particle diameter of 1.9 μm and a maximum particle diameter of 5.1 μm. Sample D has an average particle diameter of 0.9 μm and a maximum particle diameter of 2.3 μm. Sample A has a specific surface area of 0.23 $m^2/g$; sample B has a specific surface area of 0.85 $m^2/g$; sample C has a specific surface area of 5.88 $m^2/g$; and sample D has a specific surface area of 16.13 $m^2/g$.

As to samples B and C, the ratio of average particle diameter is 4.4 μm: 1.9 μm and the ratio of specific surface area is 0.85 $m^2/g$: 5.88 $m^2/g$. The specific surface area of sample C increases sharply. The abrupt increase in the particle specific surface area of sample C relative to sample B is believed due to the particles in sample C having a scale-like shape.

As to samples C and D, it is found that the particle diameter is more micronized when sample B is ground through the bead mill method for a longer time. Hence, the non-evaporation getter material ZrV can change its particle size through changing the grinding time in the bead mill method (MP2).

Figure 6:
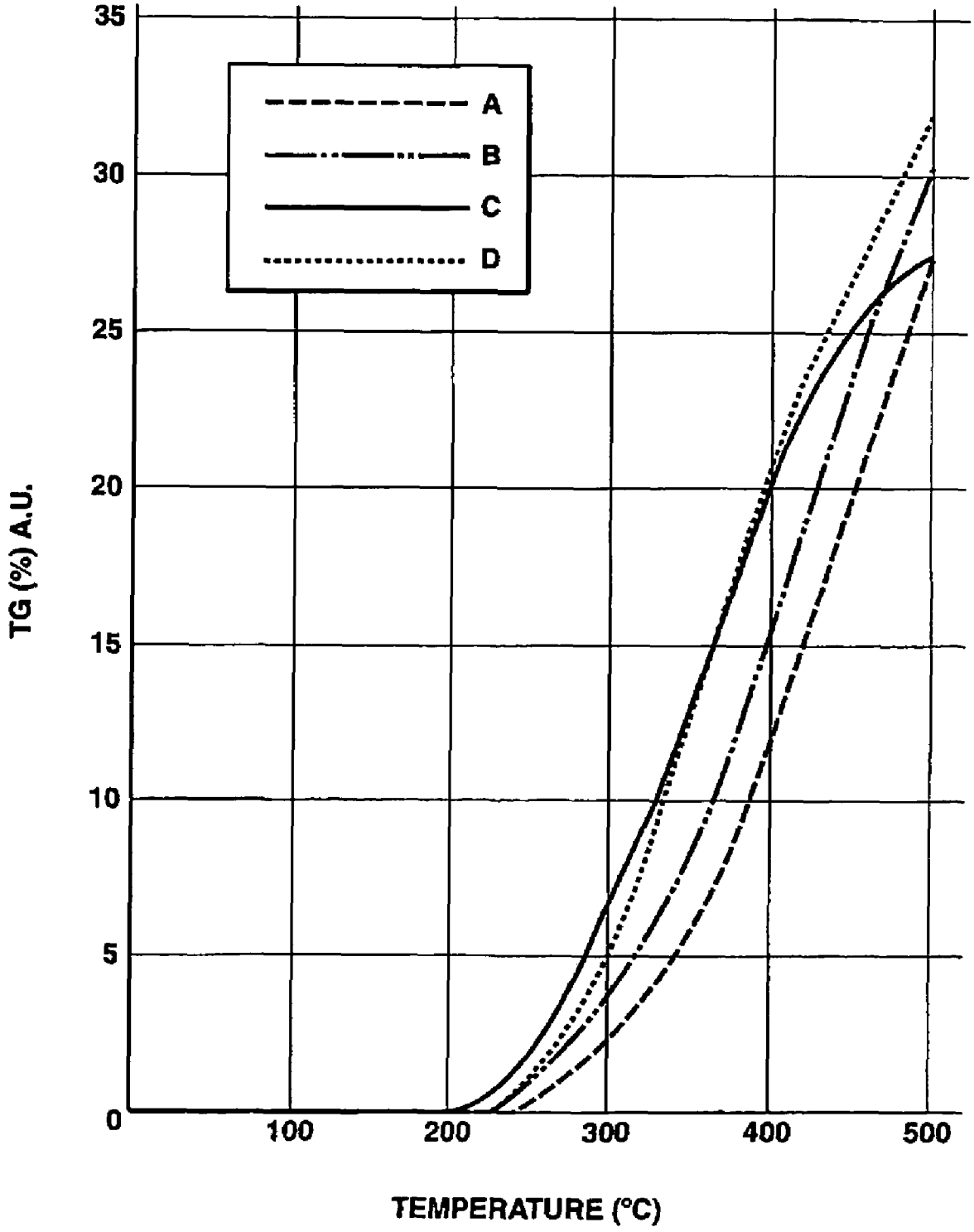
FIG. 6 is a graph plotting results of thermogravimetric (TG) analysis of both non-evaporation-type getters according to an embodiment of the present invention and raw non-evaporation-type getter materials.

FIG. 6 is a graph plotting thermogravimetric (TG) results of samples A, B, C and D. In FIG. 6, letters A, B, C and D correspond to samples A, B, C and D, respectively. The graph shown in FIG. 6 plots relations on sample weight (vertical axis) versus sample temperature (horizontal axis). With increasing temperatures, a non-evaporation getter material ZrV absorbs gases (oxygen) through the chemical reaction, thus gaining its weight. Hence, the degree of weight increase of the getter corresponds to the degree of activation of the non-evaporation getter material ZrV.

In a comparison of graphs A to D, the graphs indicate that samples C and D can absorb at temperatures lower than samples A and B. This indicates that the non-evaporation getter material ZrV, having an average particle diameter of 1.9 μm (about 2 μm) or less of sample C and a specific surface area of 5.88 $m^2/g$ (about 5 $m^2/g$) or more of sample D, can actively absorb gases at even lower temperatures. Accordingly, sample D, having an average particle diameter smaller than that of sample C and a specific surface area larger that than of sample C, can actively absorb gases at even lower temperatures.

In order to maintain a high degree of vacuum in the field emission device, the non-evaporation getter must absorb gases in the sealing and evacuating step in a field emission display fabrication process to increase the degree of vacuum and absorb gases generated when the field emission display is operating as a display device. Since the temperature of the non-evaporation getter is lower during the operation of the display device, compared with the temperature in the sealing and evacuating step, the non-evaporation getter must be capable of absorbing sufficient gases at lower temperatures to maintain the proper vacuum in the display device. As described above, samples C and D absorbs gasses at lower temperatures compared to samples A and B. Accordingly, samples C and D and are preferred for use as a non-evaporation getter.

A non-evaporation getter material for each sample is ZrV. However, $ZrH_2$ can be also used as described later. $ZrH_2$ has a scale-like shape and has an average particle diameter of 1.5 μm or less (through laser diffraction) and a specific surface area of 13.1 $m^2/g$ or more (through the BET method). $ZrH_2$ generates hydrogen at a heating temperature of 300° C. or more (or an activation temperature of about 300° C.). In this case, $ZrH_2$ becomes rich in $H_2$ within the vacuum envelope, while resulting in a shortage of oxygen through the gettering effect of Zr. This leads to a preferable reduction atmosphere inside the vacuum envelope. Particularly, when carbon nonotube are used for cathodes, the carbon converts easily into $CO_2$ through the reaction with oxygen. However, the reduction atmosphere maintained in the vacuum envelope prevents the reaction of carbon and oxygen so that degradation of cathodes can be prevented.

Figure 7A:
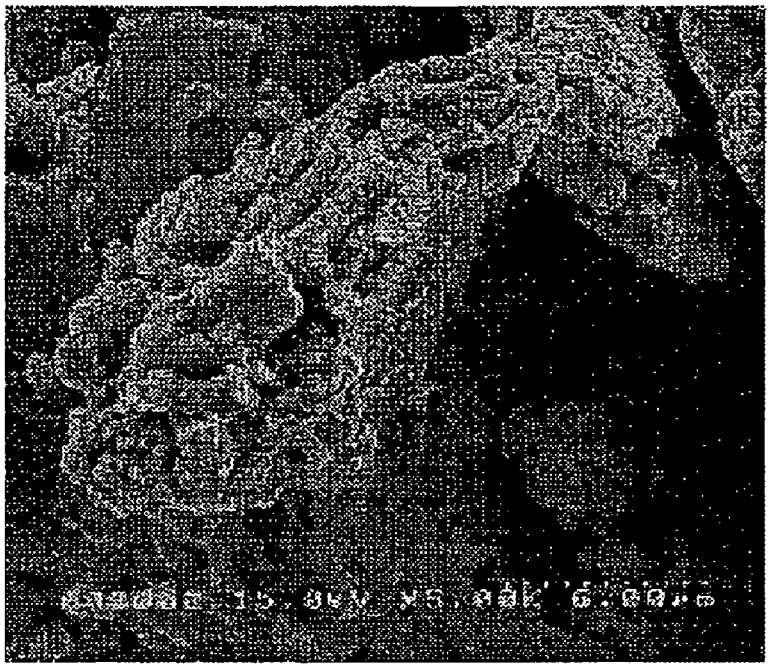
FIG. 7(*a*) is a photograph under a scanning electron microscope showing a non-evaporation-type getter according to an embodiment of the present invention.
Figure 7B:
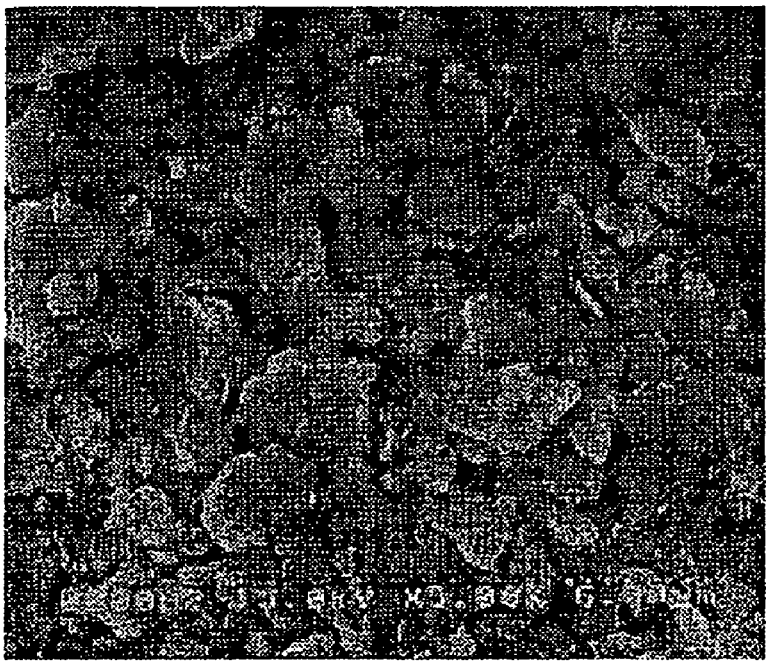
Figure 8A:
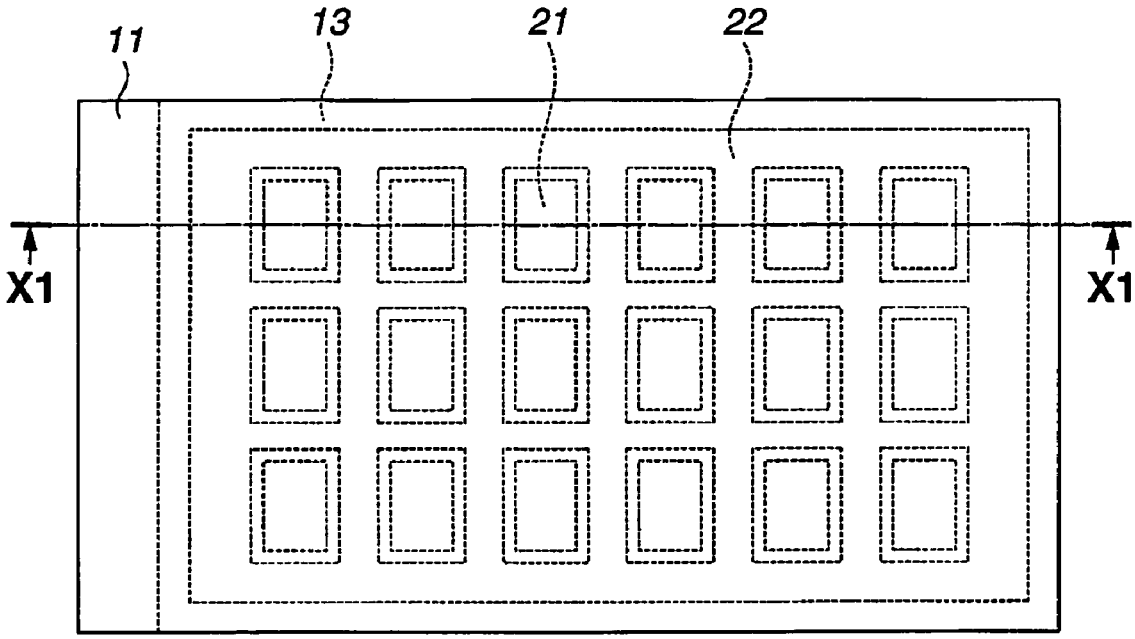
FIG.8(a) (PRIOR ART)
FIG. 8(*a*) is a front view illustrating a conventional fluorescent luminous tube.
Figure 8B:
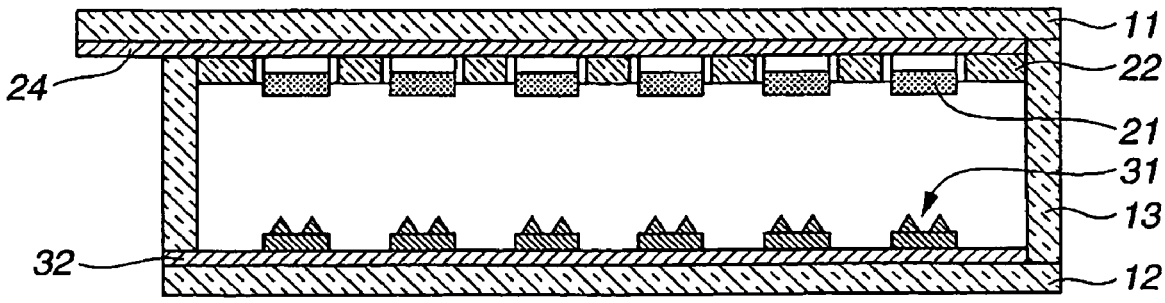
FIG.8(b) (PRIOR ART)

FIG. 7 shoes scanning electron microscopic (SEM) photographs of samples A and C. FIG. 7(*a*) is a SEM photograph of sample A, and FIG. 7(*b*) is a SEM photograph of sample C. In comparison of the photograph of FIG. 7(*a*) and the photograph of 7(*b*), the particles in FIG. 7(*a*) are three-dimensional but the particles in FIG. 7(*b*) are in a flat and scale-like state. Therefore, the non-evaporation getter material ZrV of sample A is made of three-dimensional particle but the non-evaporation getter material ZrV of sample C is made of flat and scale-like particles. Referring to FIG. 7, the length ratio of scale-like particle (or the ratio of vertical length to horizontal length or thickness) is approximately 1:5 or more (or an average ratio of 1:30 or more). Hence, it is preferable that the length ratio is 1:5 or more.

The average particle diameter is measured by radiating a laser beam toward a non-evaporation getter material dispersed in a solution. In the solution, there are scale-like particles in a mixed state and facing in different directions, that is, particles to which the laser is radiated vertically, particles to which the laser is radiated horizontally, particles to which the laser is radiated in a thickness direction, particles to which the laser is radiated at an angle, and so on. In the case of powdered non-evaporation getter materials, the scanning electron microscopic photograph shows scale-like particles facing in different directions. Hence, the photograph of sample C in FIG. 7(*b*) shows some particles having diameters larger than the average particle diameter. The average particle diameter tends to be shorter than the longer side shown in the scanning electron microscopic photograph.

Referring to FIGS. 5, 6 and 7, sample A has a large average particle size and a large specific surface area and the particle shape is three-dimensional. Sample C has a small average particle size and a large specific surface area and each particle is flat and in a scale-like shape. It is considered that the specific surface area of sample C is large because the average particle diameter is small and each particle is flat and in a scale-like shape. This feature allows sample C to absorb gases at temperatures lower than of sample A. Moreover, the bead mill method may contribute to the flat scale-like shape of each particle in sample C, in terms of the grinding process of FIG. 5.

A non-evaporation getter material (ZrV) paste, used in the getter printing step forming the field emission display, is produced by mixing Zr and V at a ratio of 50:50 by weight to form the non-evaporation getter material. Octane diol, acting as an organic solvent, and ultrafine powder $SiO_2$, acting as an inorganic binder, are also mixed together in 90:10 (weight ratio). The non-evaporation getter material and solvent/binder mixture are mixed together at a ratio of approximately 70:30 to form the non-evaporation getter material (ZrV) paste. Advantageously, dispersing the ultrafine powder in the organic solvent coats the powder and reduces the risk of flashing.

The above ratios of material forming the paste are preferred. However, these ratios can be varied without departing from the scope of the invention. For example, the ratio of octan diol, acting as an organic solvent, and ultrafine powder $SiO_2$, acting as a binder, can be between about 50:50 to 90:10. The ratio of non-evaporation getter material to a solvent/binder mixture can range between about 50:50 to 90:10. The organic solvent can be Terpineol (a heating temperature of 230° C. and a heating time of 10 minutes), Menthanol (a heating temperature of 150° C. and a heating time of 10 minutes), or methyl butyrate (NG120) (a heating temperature of 230° C. and a heating time of 10 minutes). The inorganic binder can be ultrafine powder, such as ZnO, $ZrO_2$, and $ZrSiO_4$.

The resulting non-evaporation getter material, ZrV, having a scale-like particle form, has a high physical adhesive property. As a result, once the paste is coated and dried, the non-evaporation getter material is difficult to remove without calcination. As to sample D, the non-evaporation getter material having an average particle diameter of 0.9 μm or less does not require using the binder to be mixed.

The electron device described above has a vacuum envelope formed of an anode substrate and a cathode substrate bonded with a seal glass, has been explained. However, an alternate electron device can be formed having a vacuum envelope formed of an anode substrate, a cathode substrate and side plates, bonded together with a seal glass without departing from the scope of the invention. In this alternate electron device, an evacuation hole or evacuation tube can be formed in a vacuum envelope formed of an anode substrate and a cathode substrate, bonded with the seal glass. The evacuation hole may be sealed with a cover after evacuation or the evacuation tube may be melted for sealing.

In another embodiment of the invention, the anode substrate and the cathode substrate are bonded with a seal glass. A getter box communicating with at least the envelope space is bonded with a seal glass. An evacuation hole or tube is formed in the getter box or envelope. The evacuation hole is sealed with a cover or the evacuation tube is melted for sealing.

In the above embodiment, the non-evaporation getter is attached to the inner surface of the vacuum envelope or to a component inside the vacuum envelope. However, in the case of the electron device with the getter box, the getter can be mounted inside the getter box (to the inner surface of the getter box or to a component in the getter box) without departing from the scope of the invention.

In the above embodiments, the electron device includes a vacuum envelope. However, a hermetic envelope may be filled with a specific gas without departing from the scope of the invention. In such a case, the gettter may selectively absorb undesired gases, except the special gas, inside the hermetic envelope.

In the above embodiments, a non-evaporation getter is heated at a temperature higher than the activation temperature thereof in the sealing/evacuation step in vacuum. However, the non-evaporation getter can be heated at a temperature higher than the activation temperature thereof in the sealing step in a specific atmosphere, such as inert gas, on the condition that sufficient getter capability can be obtained even after fabrication of the hermetic vacuum without departing from the scope of the invention. Thereafter, the non-evaporation getter can be heated at a temperature higher than its activation temperature in the evacuation step in vacuum.

In the above description, the electron device is described as a diode-type field emission display. However, other types of electron devices can be formed incorporating the present invention, such as triode-type electron emission displays, multielectrode-type electron emission displays, fluorescent display tubes using hot cathode filaments, flat CRTs, luminous tubes for printer heads, and the like.

In the above description, ZrV is disclosed as a preferred non-evaporation getter material. However, other non-evaporation material may be used without departing from the scope of the invention, such as a hydride, such as $ZrH_2$, chemical compounds (alloys) such as Zr—Ti, Zr—Al, Zr—Fe—V, or Zr—Ni—F—V, and metals, such as Ta, Ti, Zr, Th, V, Al, Fe, Ni, W, Mo, Co, Nb, Hf, and a combination of them.

In the embodiment, the bead mill method (media agitation-type mill) has been explained as the getter material grinding method. However, a boll mill method (envelope drive media mill), a jet mill method, and a Nanomaizer method may be used as a getter material grinding method. The bead mill method is believed to be most suitable to micronize getter materials (to, for example, an average particle diameter of 2 μm or less).

While there has been shown and described what is at present considered the preferred embodiment of the invention, it will be obvious to those skilled in the art that various changes and modifications can be made therein without departing from the scope of the invention defined by the appended claims.

What is claimed is:

1. An electron device, comprising, a hermetic envelope; and a non-evaporation getter disposed in said hermetic envelope; said non-evaporation getter being formed of a non-evaporation getter material selected from the group consisting of a chemical compound of Zr and a hydride of Zr; said non-evaporation getter material having an average particle diameter of 2 μm or less, a specific surface area of 5 $m^2/g$ or more, and a flat scale-like particle form.

2. The electron device defined in claim 1, wherein the maximum particle diameter of said non-evaporation getter material is 5.1μm or less.

3. An electron device comprising, a hermetic envelope; and a non-evaporation getter disposed in said hermetic envelope; said getter being formed of a non-evaporation getter material selected from the group consisting of a chemical compound of Zr and a hydride of Zr; said non-evaporation getter material having an average particle diameter of 0.9μm or less, a specific surface area of $16m^2/g$ or more, and a flat scale-like particle form.

4. The electron device defined in claim 3, wherein the maximum particle diameter of said non-evaporation getter material is 2.3μm or less.

5. The electron device defined in claim 1, wherein said non-evaporation getter material is ZrV or $ZrH_2$.

6. The electron device defined in claim 2, wherein said non-evaporation getter material is ZrV or $ZrH_2$.

7. The electron device defined in claim 3, wherein said non-evaporation getter material is ZrV or $ZrH_2$.

8. The electron device defined in claim 1, wherein the length ratio of each particle of said non-evaporation getter material is 1:5or more.

9. The electron device defined in claim 2, wherein the length ratio of each particle of said non-evaporation getter material is 1:5or more.

10. The electron device defined in claim 3, wherein the length ratio of each particle of said non-evaporation getter material is 1:5or more.

* * * * *

UNITED STATES PATENT AND TRADEMARK OFFICE

CERTIFICATE OF CORRECTION

PATENT NO. : 7,586,260 B2
APPLICATION NO. : 11/358638
DATED : September 8, 2009
INVENTOR(S) : Tonegawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 535 days.

Signed and Sealed this

Fourteenth Day of September, 2010

David J. Kappos

David J. Kappos
*Director of the United States Patent and Trademark Office*